US005407549A

United States Patent [19]

Camp

[11] Patent Number: 5,407,549

[45] Date of Patent: Apr. 18, 1995

[54] ELECTRONIC CORROSION PROTECTION SYSTEM

[76] Inventor: Warren J. Camp, 1001 Tecumseh Way, Scotia, N.Y. 12302

[21] Appl. No.: 145,774

[22] Filed: Oct. 29, 1993

[51] Int. Cl.[6] ..... C23F 13/00

[52] U.S. Cl. ..... 204/196; 204/147

[58] Field of Search ..... 204/196, 197, 147

[56] References Cited

U.S. PATENT DOCUMENTS

| | | | |
|---|---|---|---|
| 2,758,080 | 8/1956 | Bernard | 204/197 |
| 3,151,050 | 2/1963 | Wilburn | 204/196 |
| 3,242,064 | 3/1966 | Byrne | 204/196 |
| 3,498,898 | 3/1970 | Bogart et al. | 204/196 |
| 3,772,179 | 11/1973 | Beer | 204/197 |
| 4,061,965 | 12/1977 | Nelson | 204/197 |
| 4,226,694 | 10/1980 | Baboian et al. | 204/197 |
| 4,644,285 | 2/1987 | Britton | 204/196 |
| 4,647,353 | 3/1987 | McCready | 204/196 |
| 4,767,512 | 8/1988 | Cowatch et al. | 204/196 |
| 4,828,665 | 5/1989 | McCready | 204/196 |
| 4,950,372 | 8/1990 | McCready | 204/196 |

*Primary Examiner*—John Niebling
*Assistant Examiner*—Kishor Mayekar
*Attorney, Agent, or Firm*—Schmeiser, Olsen & Watts

[57] ABSTRACT

An automobile corrosion protection apparatus incorporating, in combination, a electronic cathodic protection system for impressing a flow of electrons through the metal body of an automobile, and an electrically conductive auto body sealant for facilitating the transmission of the electrons, provided by the electronic cathodic protection system, to any cracks, scratches, chips and other corrosion prone areas throughout the metal body of the automobile.

5 Claims, 4 Drawing Sheets

ELECTRONIC CORROSION PROTECTION SYSTEM

FIELD OF THE INVENTION

The present invention relates to automobile corrosion and, more particularly, to a corrosion protection apparatus which combines an electronic cathodic protection system for impressing a flow of electrons through the metal body of an automobile, with an electrically conductive auto body sealant, thereby enhancing the flow of electrons supplied by the electronic cathodic protection system to any cracks, scratches, chips and other holidays located on the metal body of the automobile.

BACKGROUND OF THE INVENTION

In accordance with the laws of thermodynamics, unprotected steel will always return to a state of low energy by corroding into iron oxide, its most relaxed, low energy form. In an effort to combat the deleterious effects of corrosion, automobile manufacturers have long shielded the steel body of an automobile with a protective, multilayered coating of paint. Unfortunately, during normal usage, cracks, scratches, dings, and other pores form in the protective coating of paint, resulting in the inevitable corrosion of the exposed, underlying steel.

Corrosion is a complex, continuous electrochemical process which occurs when the steel of an automobile is exposed to an electrolyte such as water. First, water comes in contact with the underlying steel, after passing through a scratch or the like in the protective coating of paint. Shortly thereafter, a solution comprising a small amount of dissolved iron is formed as the oxygen in the water combines with the iron in the steel, thus establishing a miniature electrochemical circuit ("corrosion cell"), wherein the imbalance of electrons between the solution and the surrounding steel creates a minute flow of electrons, or current. Unfortunately, as long as a current is allowed to flow, the steel will deteriorate, resulting in corrosion and pitting. Heretofore, automobile corrosion has been combatted using either a supplementary, protective chemical barrier, or a cathodic protection system. Unfortunately, as described in detail below, neither of these approaches have provided an effective and environmentally friendly, solution to the ever present, unstoppable forces of corrosion.

The most common method of preventing automotive corrosion requires the application of a supplementary dielectric chemical barrier, commonly designated as an "undercoating". Although such barriers do provide a certain degree of sound absorption and abrasion resistance, they do not effectively inhibit corrosion. More specifically, it is oftentimes very difficult, if not impossible, to apply a chemical barrier to all of the corrosion vulnerable areas of an automobile, even with the most sophisticated spraying equipment. Further, as known in the art, the application process typically violates the integrity of the automobile metal by requiring the drilling of a multitude of access holes therethrough, seals in moisture, and fouls window regulators, seat belt restrainers and other components of the automobile, potentially resulting in the nullification of the manufacturers warranty. Finally, regardless of the type of chemical barrier, surface electrolytes will eventually migrate through the barrier to the underlying metal of an automobile through transport phenomena such as osmosis, or through fissures in the chemical barrier, inexorably resulting in the formation of extensive corrosion beneath the protective chemical barrier. Regardless of the above-detailed disadvantages, the utilization of chemical corrosion barriers has drastically decreased over the last decade due in part to the environmental and health risks of the application process and the associated expenditures required to fully comply with the plethora of mandates set forth by the Environmental Protection Agency (EPA), the Occupational Health and Safety Administration (OSHA) and other governmental agencies. As a result, nonchemical substitutes, including cathodic protection systems, have been increasingly employed to combat corrosion.

Impressed current cathodic protection systems have long been utilized to effectively protect pipelines, bridges, ships and other metal objects against the destructive influences of corrosion. As known in the art, such cathodic protection systems are theoretically designed to inhibit corrosion by impressing a reverse current at each corrosion cell on the metal object. Generally, the impressed current is produced by coupling the output of a voltage source to the metallic object, or "cathode", which is to be afforded corrosion protection, through at least one resistive anode.

Recently, electronic cathodic protection systems have been developed to inhibit automobile corrosion. In a typical automotive application, the battery of the automobile is utilized as the source of power, and a plurality of anodes are distributed about the metal body of an automobile. Unfortunately, such systems, although providing a limited degree of corrosion protection in the general vicinity of each anode, have not been suitably designed to provide effective corrosion protection about the entire body of an automobile. Further, it has been established that the most significant area of corrosion is generally disposed at those points where the anodes are coupled to metal body (cathode) of the automobile. Although many attempts have been made to develop a corrosion resistant anode-cathode coupling, none of the currently available coupling systems effectively reduce corrosion at the anode-cathode coupling points on the automobile.

SUMMARY OF THE INVENTION

In order to avoid the disadvantages of the prior art, the present invention provides an automobile corrosion protection apparatus incorporating, in combination, a novel electronic cathodic protection system for impressing a flow of electrons through the metal body of an automobile, and an electrically conductive auto body sealant for facilitating the transmission of the electrons, provided by the electronic cathodic protection system, to any cracks, scratches, chips and other corrosion prone areas throughout the metal body of the automobile. Advantageously, the electrons supplied by the electronic cathodic protection system of the present invention flow to each corrosion cell not only through the body of the automobile, but also through the electrically conductive auto body sealant, effectively sandwiching each corrosion cell with corrosion inhibiting electrons.

In accordance with the present invention, the electronic cathodic protection system of the present invention incorporates at least one anode which is removably biased against the metal body (cathode) of an automobile to be protected. The pulsating output of a voltage/-current generation unit is magnetically coupled to each anode, thereby providing an induced voltage thereacross and producing a current which flows into the cathode. In order to avoid the anode-cathode corrosion commonly associated with prior art cathodic protection systems, each anode of the present invention is intermittently impacted against its corresponding anode-cathode interface; the impacting of sufficient, yet not periodic intensity and repetition so as to maintain cleanliness of the impact point. Each impacting anode and associated magnetic coupling arrangement is enclosed in a moisture-resistant housing and secured to the automobile to be protected using a suitable adhesive material.

The battery of the automobile to be protected is utilized to provide the source voltage for the pulsating voltage/current generation unit the battery: is generally grounded to the automobile chassis and serves as the ground point for the pulsating voltage/current generation unit and each anode into which a voltage will be induced through magnetic (inductive) coupling.

In the preferred embodiment, an air core coil, enclosing an essentially cylindrical, spring biased anode which is preferably formed of steel, and a circuit board incorporating the pulsating voltage/current generation unit (hereinafter referred to as the ECP unit), are suitably mounted within a main housing. Correspondingly, at least one remote, essentially cylindrical, spring biased anode, each anode again enclosed within an air core and preferably formed of steel, is individually protected within a remote housing. Electrically, the ECP unit outputs a pulsating DC voltage which is inductively coupled to each spring biased anode through an associated air core coil, wherein each anode is spring biased against, and in contact with, the cathode. A voltage is subsequently induced in each anode, producing a current which flows through the anode into the cathode. Although the induced voltage is relatively low, the resistance between anode and cathode, as determined by the composition of the anode and the cross sectional contact made, is very low and results in a relatively high current passing through the electronic cathodic protection system of the present invention. This relatively high current insures that sufficient excess electrons will be available at the cathode to discouraged the more common forms of electrochemical corrosion that generally occur at breaks or "holidays" in the various protective coatings used on modern automobiles.

Notwithstanding the above-stated electrical, corrosion inhibiting operation of the present invention, each spring biased anode is designed to be intermittently impacted against the body of the automobile (cathode) as the automobile encounters bumps or the like during normal operation, thereby maintaining the anode-cathode interface in a substantially corrosion free state. Adjustment on the biasing spring is accomplished by a turn-down screw which projects from the top of the main and remote housings. Since the movement of each anode is a relatively rare occurrence, the impacting thereof against the cathode may be adjusted or regulated so that occasional anode movement will maintain the cleanliness of anode-cathode interfaces, thus ensuring a substantially constant interface resistance.

The electrically conductive auto body sealant of the present invention provides a high gloss, hard shell finish which is adapted to seal the painted surface of an automobile, thereby protecting the automobile from environmental damage due to ultraviolet rays, commercial detergents, pollutants, and weather induced deterioration such as acid rain and the like. Further, the electrically conductive auto body sealant enhances the corrosion inhibiting performance of the above-described electronic cathodic protection system by facilitating the flow of impressed electrons to actual or potential corrosion sites disposed about the metal body of the automobile. In practice, a wide variety of electrically conductive sealants, coatings and the like may be utilized to facilitate the transmission of electrons as described above. The composition of a suitable, electrically conductive auto body sealant, in accordance with a preferred embodiment of the present invention, is set forth in detail in Table 1.

TABLE 1

COMPOSITION OF ELECTRICALLY CONDUCTIVE SEALANT

| INGREDIENT | AMOUNT (grams) |
|---|---|
| WATER | Q/S (QUANTITY SUFFICIENT) |
| SODIUM POLYACRYLATE | 0.5 |
| MAGNESIUM ALUMINUM SILICATE | 1.0 |
| KAOLIN CLAY | 10.0 |
| CARNAUBA WAX | 5.0 |
| POLYTETRAFLUOROETHANE | 0.5 |
| TALL OIL FATTY ACID | 4.0 |
| DIMETHYL POLISILOXANE | 3.5 |
| TRIMETHYL SILOXANE | 1.5 |
| MORPHOLINE | 0.8 |
| TRIETHANOLAMINE | 0.2 |
| HYDROTREATED LIGHT DISTILLATES | 16.5 |
| COPPER SULFATE | 2.0 |

BRIEF DESCRIPTION OF THE DRAWINGS

These and other features of the present invention will become readily apparent upon reading the following detailed description and upon reference to the drawings in which.

DETAILED DESCRIPTION OF THE INVENTION

Figure 1:
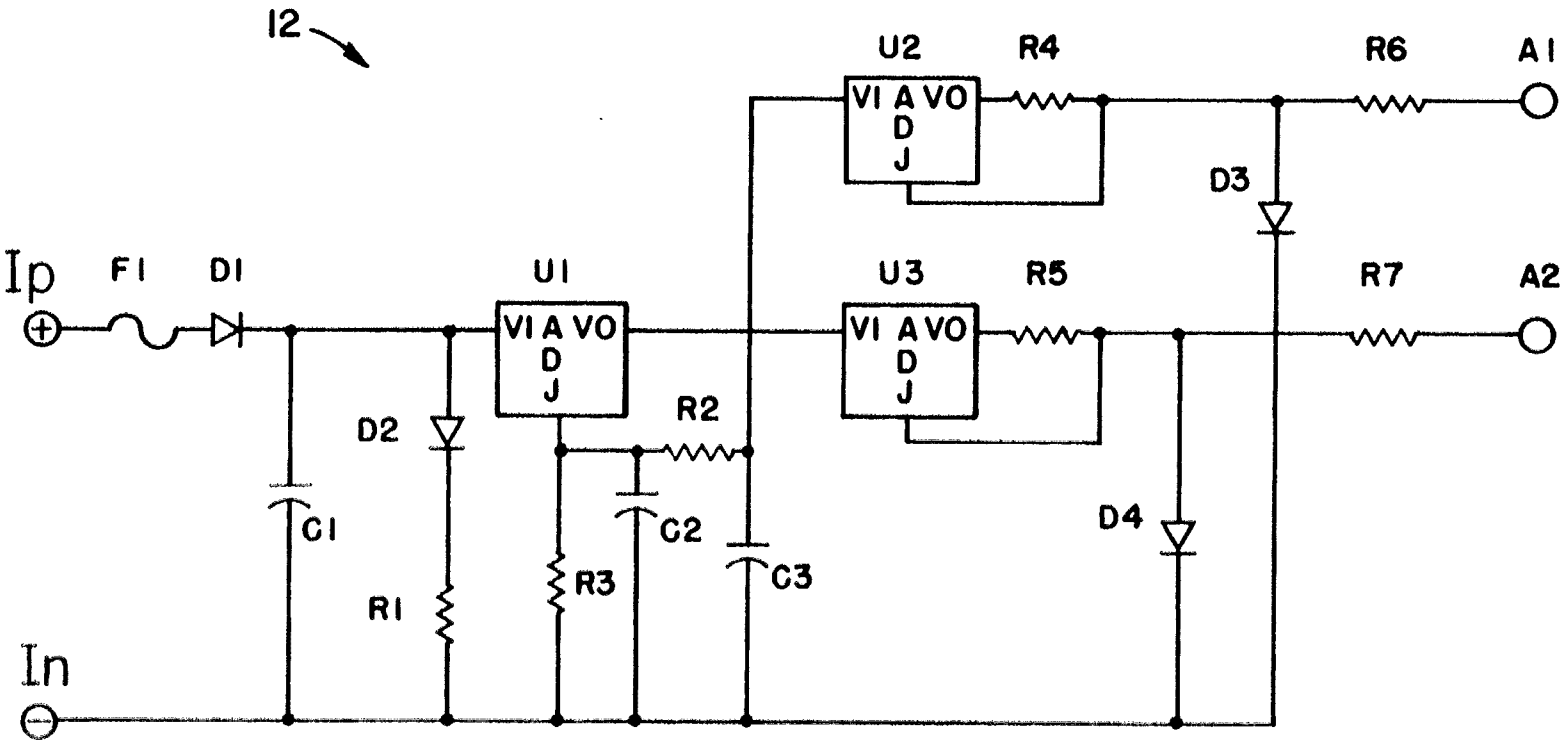
FIG. 1 is an electrical schematic of the ECP unit.

Referring now specifically to the drawings, there is illustrated a corrosion protection apparatus according to a preferred embodiment of the present invention, wherein like reference numerals refer to the same components throughout the drawings.

Figure 2:
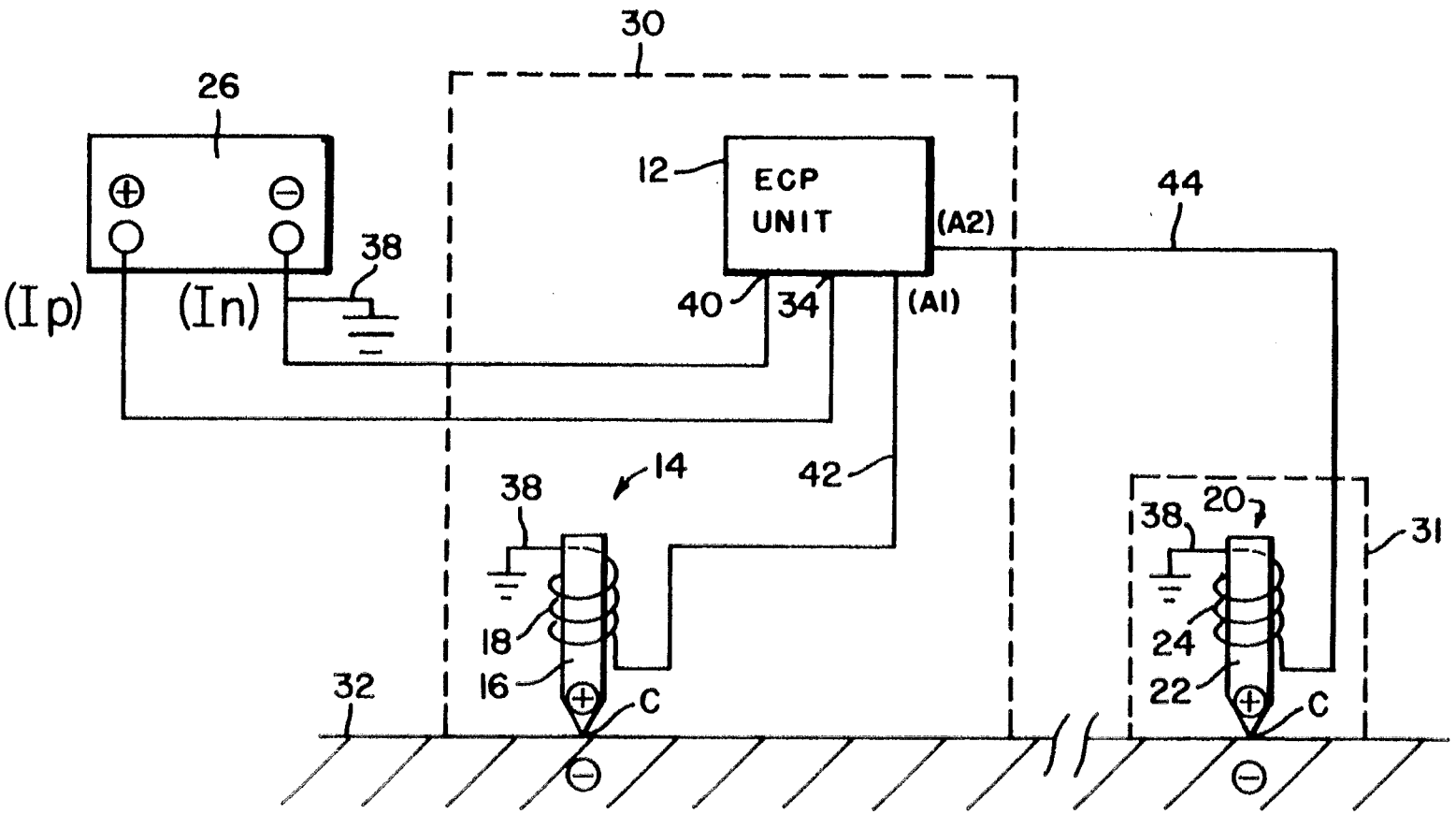
FIG. 2 is a wiring schematic of the electronic cathodic protection system of the present invention, illustrating the relationship between the ECP unit, the vehicle power supply and the main and remote air core coil/anode arrangements.

The electronic cathodic protection system, generally designated as 10, is presented in detail in FIGS. 1 and 2. More specifically, a pulsating voltage/current generation unit (ECP unit) 12 is utilized to provide pulsating DC power to a main inductor unit 14, comprising a first anode 16 enclosed by an air core coil arrangement 18, and a remote inductor unit 20, comprising a second anode 22 enclosed by a corresponding air core coil arrangement 24. Although the preferred embodiment of the present invention employs only two inductor units, namely the main inductor unit 14 and the remote inductor unit 20, it should be readily evident that the ECP unit 12 may be easily modified to support an additional number of remote inductor units and the associated anodes therein.

The nominal output of the ECP unit 12 is 6 volts DC at output terminals A1 and A2. Input terminals $I_p$ and $I_n$ are connected to the positive and negative terminals, respectively, of a standard automotive 12 volt power supply (battery) 26. A fuse F1, preferably having a $\frac{1}{4}$ amp rating, is disposed at the input of the ECP unit to prevent system damage due to power surges or other deleterious electrical conditions. Similarly, a diode D1 is provided in series with fuse F1, to prevent system damage due to any reverse polarity situations. To avoid overcurrent conditions, thereby preventing excessive drain on the automotive battery 26, even at a dead short, limiting resistors R6 and R7 are provided at output terminals A1 and A2, respectively. The specific circuit components utilized in the electrical schematic of the ECP unit, as illustrated in FIG. 1, are provided in Table 2.

TABLE 2

| COMPONENT | VALUE/PART # |
|---|---|
| R1 | 2.2 kΩ |
| R2 | 240 Ω |
| R3 | 1.2 kΩ |
| R4 | 30 Ω |
| R5 | 30 Ω |
| R6 | 82 Ω |
| R7 | 82 Ω |
| C1 | 0.1 μF |
| C2 | 10 μF |
| C3 | 4.7 μF |
| U1 | LM317 |
| U2 | LM317 |
| U3 | LM317 |

In the embodiment disclosed hereinafter, the ECP unit 12 and the main inductor unit 14 are preferably integrated on a single circuit board using surface mount technology, and are encased within a moisture-resistant main housing 28 as indicated by dotted line 30. Similarly, the remote inductor unit 20 is encased within a moisture-resistant remote housing as indicated by dotted line 31. Advantageously, by utilizing surface mount technology in lieu of the conventional insertion of individual, bulky electrical components, the required surface area of the circuit board is dramatically reduced. Further, the electrical components operate at a much lower operational temperature, thereby creating less draw against the battery 26.

Air core coil arrangements 18, 24 are of normal configuration, rated at 6 mh, and are driven by the ECP unit 12 at about 6 volts DC, 42.5 milliamps, and at a pulsation rate of 3 Hz. The resultant voltage induced across the anodes 16, 22, each having a diameter and length of approximately 10 and 50 mm, respectively, and a resistance of approximately 0.2 ohms, is generally in the 3–5 millivolt range, thereby resulting in an anode current of about 15–25 milliamps. Since current is a function of electron flow (past an index), it is submitted that, because of direct anode coupling the current in each anode 16, 22, is more than sufficient to inhibit corrosion by supplying a significant electron population to the metal body of an automobile (cathode) 32 at contact points C. The anode current may be scaled up or down between about 1 milliamp to 10 amperes by adjusting the output voltage(s) of the ECP unit 12 at output terminals A1 and A2, through appropriate adjustment of voltage regulators U1, U2 and U3, resulting in a correspondingly higher or lower induced voltage in anodes 16, 22.

The functional wiring scheme is more readily understood by reference to FIG. 2. More specifically, there is illustrated the automotive battery 26 having its positive terminal $I_p$ removably connected to the positive input terminal 34 of the ECP unit 12 through a wiring harness connector 36 (see FIG. 3). The negative terminal $I_n$ of the automotive battery 26 is grounded as indicated by reference numeral 38, and is removably connected to the negative input terminal 40 of the ECP unit 12, again through the wiring harness connector 36. Analogously, the negative side of the air core coil arrangements 18, 24, in the main and remote inductor units 14 and 20, respectively, are grounded at 38. Output terminal A1 is directly connected to the input lead 42 of the main inductor unit 14, and output terminal A2 is removably coupled to the input lead 44 of the remote inductor unit 20, once again through the wiring harness connector 36.

Figure 3:
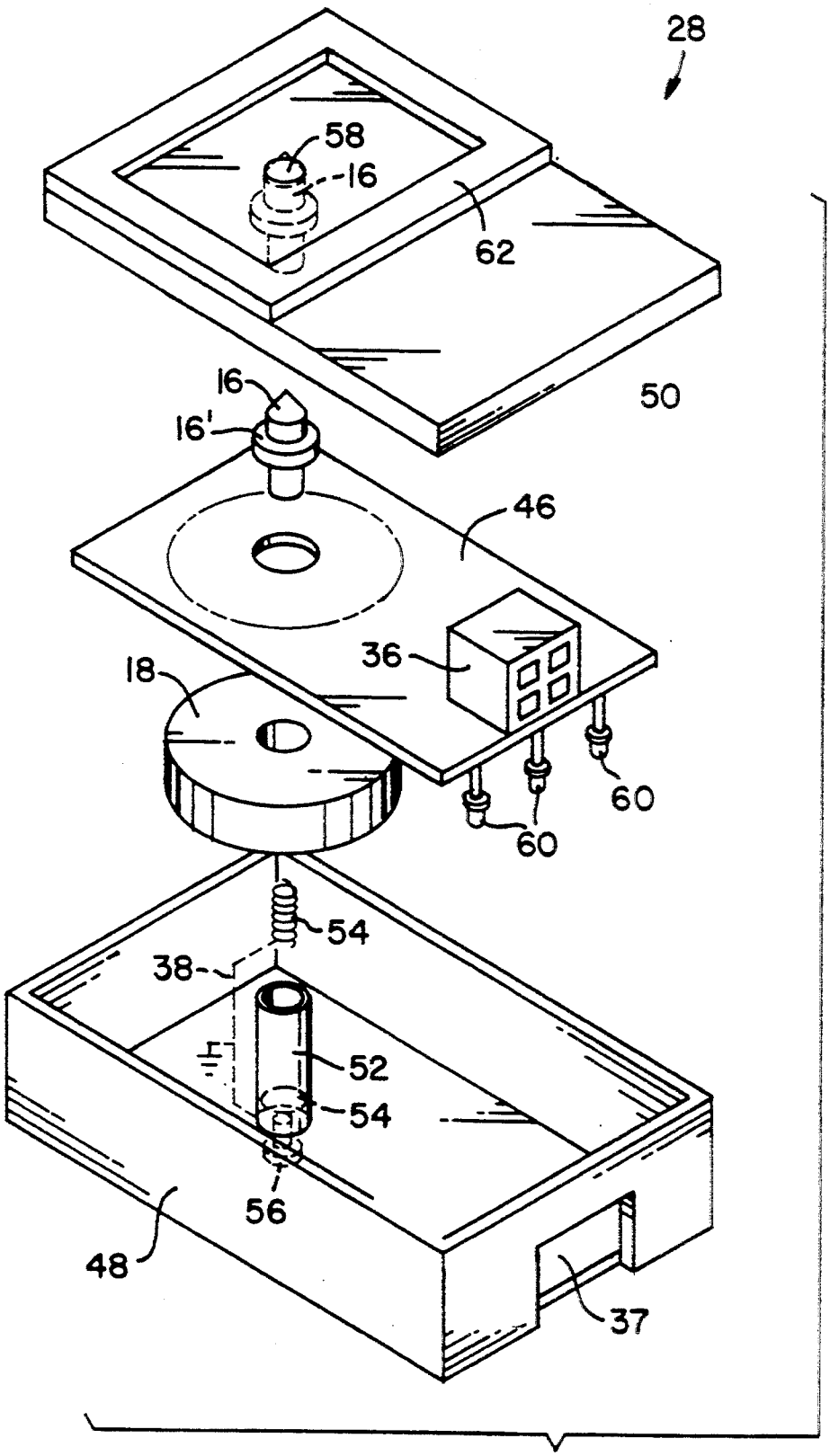
FIG. 3 is an exploded isometric view of the electronic cathodic protection system.

Referring now specifically to FIG. 3, there is illustrated an exploded isometric view of the main housing 28 which, as disclosed above, encloses a circuit board 46 incorporating the ECP unit 12 and the air core coil arrangement 18 of the main inductor unit 14 thereon. Although the following description is specifically directed toward the main housing 28, it should be noted that the remote housing, as indicated by dotted line 31 and including the remote induction unit 20, is formed in a substantially similar manner. The main housing 28 includes a top portion 48 and a bottom portion 50, each preferably formed of a nonconducting plastic material and adapted to be secured together in a moisture-resistant manner as known in the art. Within the top portion 48 is a fixed hollow cylindrical tube 52 for aligning and securing the circuit board 46 to and inside the top portion 48 of the main housing, and for receiving and enclosing the first anode 16 of the main inductor unit 14 therein. The wire harness connector 36 is utilized to removably connect the positive and negative battery terminals $I_p$, $I_n$ to the ECP unit on the circuit board 46. Similarly, the wire harness connector 36 is utilized to removably connect the ECP unit output terminal A2 on the circuit board 46 to the input lead 44 of the remote inductor unit 20. An aperture 37 in the top portion 48 of the main housing provides external access to the wire harness connector 36. The main housing ground, which simultaneously serves as the automobile chassis ground and the main inductor unit ground, is effected through the wire harness connector 36. Hereinafter, all references to ground relate to the same electric potential experienced for the battery 26, the cathode 32, the ECP unit 12 and the main and remote inductor units 14, 20.

As further illustrated in FIG. 3, the fixed, hollow cylindrical tube 52 is adapted to receive thereinside a biasing spring 54 for adjustably biasing the anode 16 against the metal body of an automobile, and a tension adjustment plate 54. A biasing adjustment screw 56, having a top portion which protrudes through the top 48 of the main housing and a bottom portion which rests against the tension adjustment plate 54, is utilized to adjust the degree of bias afforded by the biasing spring 54. In operation, anode 16 protrudes through the bottom portion 50 of the main housing through an aperture 58, wherein anode collar 16' is provided to retain the anode 16 within the main housing. Biasing spring 54 is grounded to the main housing through the tension adjustment plate 54 and the biasing adjustment screw 56 as indicated by reference numeral 38, or by any suitable wiring means. A plurality of LEDs 60, each protruding through the top portion 48 of the main housing (not shown) are utilized to provide a visual indication of circuit operation.

When fully assembled, the main and remote housings 28, 31, are adhesively attached to a portion of the metal body of the automobile (cathode) 32 which is to be afforded corrosion protection. An adhesive sealing material 62, preferably a nonconductive, moisture-resistant epoxy adhesive or the like, is applied adjacent the aperture 58 on the bottom portion of the main and remote housings to prevent moisture from entering therethrough to the contact points C illustrated in FIG. 2.

During actual operation, since the area surrounding the anode aperture 58 and enclosed by the seal 62 is effectively sealed, very little corrosion can occur at contact point C, other than surface oxidation. To ameliorate even this corrosive effect, which may increase resistivity in the anode-to-cathode circuit, the biasing adjustment screw 56 may be manipulated in accordance with anticipated road conditions. More specifically, adjustments should be such that only periodically will a "jolt" or "bounce" be sufficient to dislodge the anodes 16, 22 from their respective contact points C. The instant the displacing force is removed or mitigated, the biasing springs 54 will rebias the anodes against contact points C, thereby abrading any corrosion that may have taken place between the anode and cathode.

Figure 4:
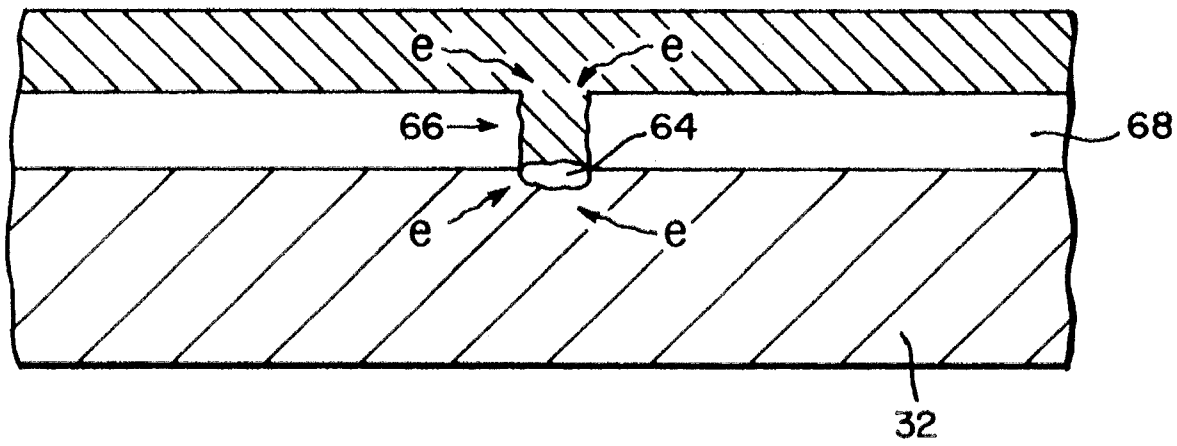
FIG. 4 illustrates the corrosion protection afforded to the metal body of an automobile by the electronic cathodic protection system and the electrically conductive auto body sealant of the present invention.

An example of the corrosion protection provided to the metal body of an automobile (cathode) 32 by the components of the corrosion protection system of the present invention is presented in FIG. 4. More specifically, a corrosion site 64 has formed due to a crack 66 in the painted surface 68 of the cathode 32. To inhibit any further corrosion, the electronic corrosion protection system 10 has been suitably secured (not shown) to the cathode 32, and an electrically conductive auto body sealant 70 has been applied over the painted surface, thereby sealing the crack 66. As illustrated, corrosion inhibiting electrons e are supplied to the corrosion site 64 not only through the cathode 32, but also through the electrically conductive auto body sealant 70.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A corrosion protection system for an automobile, wherein said automobile includes a protective coating of paint and a metal body, comprising:

an electronic corrosion protection system including at least one anode, a generating means for producing a pulsating voltage, and a system means for producing an induced voltage in each said anode by inductively coupling said pulsating voltage thereto;

an electrically conductive automotive sealant, wherein said sealant is adapted to be applied over the protective coating of paint on said automobile;

a securing member means for attaching said electronic corrosion protection system to said automobile; and a biasing arrangement means for biasing each said anode against said automobile, the induced voltage in each said anode produced an anode current which is adapted to flow into said automobile through each said anode, said anode current flowed through the metal body of said automobile and said electrically conductive automotive sealant, thereby providing cathodic corrosion protection for the metal body of said automobile.

2. The corrosion protection system according to claim 1, wherein said biasing arrangement means for biasing each said anode against said automobile further includes:

an impact member means for intermittently impacting each said anode against said automobile, thereby abrading any corrosion that may have formed therebetween.

3. The corrosion protection system according to claim 2, wherein said impact member means for intermittently impacting each said anode against said automobile further includes:

a biasing spring element means for providing a predetermined degree of bias; and an adjusting element means for varying the predetermined degree of bias provided by each said biasing spring elements means.

4. The corrosion protection system according to claim 1 further including:

means for adjusting said pulsating voltage, thereby varying the induced voltage in each said anode, and the anode current flowed through the metal body of said automobile and said electrically conductive automotive sealant.

5. A corrosion protection system for an automobile, wherein said automobile includes a protective coating of paint and a metal body, comprising:

an electronic corrosion protection system including at least one anode, a generating means for producing an adjustable, pulsating voltage, and a system means for producing an adjustable, induced voltage in each said anode by inductively coupling said adjustable, pulsating voltage thereto;

an electrically conductive automotive sealant, wherein said sealant is adapted to be applied over the protective coating of paint on said automobile;

a securing member means for attaching said electronic corrosion protection system to said automobile; and a biasing arrangement means for biasing each said anode against said automobile, the adjustable, induced voltage in each said anode produced an adjustable anode current which is adapted to flow into said automobile through each said anode, said adjustable anode current flowed through the metal body of said automobile and said electrically conductive automotive sealant, thereby providing cathodic corrosion protection for the metal body of said automobile; and an impact member means for intermittently impacting each said anode against said automobile, thereby abrading any corrosion that may have formed therebetween, said impact member means including a biasing spring element means for providing a predetermined degree of bias and an adjusting element means for varying the predetermined degree of bias provided by said biasing spring element means.

* * * * *